US009029618B2

(12) United States Patent
Serban et al.

(10) Patent No.: US 9,029,618 B2
(45) Date of Patent: *May 12, 2015

(54) INTEGRATED HYDROGENATION/DEHYDROGENATION REACTOR IN A PLATFORMING PROCESS

(75) Inventors: Manuela Serban, Glenview, IL (US); Kurt M. Vanden Bussche, Lake in the Hills, IL (US); Mark D. Moser, Elk Grove Village, IL (US); David A. Wegerer, Lisle, IL (US)

(73) Assignee: UOP LLC, Des Plaines, IL (US)

( * ) Notice: Subject to any disclaimer, the term of this patent is extended or adjusted under 35 U.S.C. 154(b) by 168 days.

This patent is subject to a terminal disclaimer.

(21) Appl. No.: 13/327,178

(22) Filed: Dec. 15, 2011

(65) Prior Publication Data

US 2013/0158311 A1 Jun. 20, 2013

(51) Int. Cl.

| | |
|---|---|
| ***C10G 35/04*** | (2006.01) |
| ***C07C 5/02*** | (2006.01) |
| ***C10G 59/00*** | (2006.01) |

(52) U.S. Cl.

CPC ..... *C10G 59/00* (2013.01); *C10G 2400/30* (2013.01)

(58) Field of Classification Search

CPC ..... C07C 5/00; C07C 5/02; C07C 5/03; C07C 5/32; C07C 5/321; C07C 5/324; C07C 5/325; C07C 4/00; C07C 4/02; C07C 4/04; C07C 4/06; C10G 35/00; C10G 35/02; C10G 35/04; C10G 35/06; C10G 35/085; C10G 35/09

USPC ..... 585/251, 300–304, 312, 315, 319, 322, 585/407, 430, 800, 804, 805

See application file for complete search history.

(56) References Cited

U.S. PATENT DOCUMENTS

| | | | | |
|---|---|---|---|---|
| 2,937,132 | A * | 5/1960 | Voorhies, Jr. | 208/64 |
| 4,914,075 | A | 4/1990 | Bricker et al. | |
| 5,935,415 | A * | 8/1999 | Haizmann et al. | 208/64 |
| 6,004,452 | A * | 12/1999 | Ash et al. | 208/80 |
| 6,740,228 | B1 * | 5/2004 | Verduijn et al. | 208/138 |
| 2007/0299289 | A1 * | 12/2007 | Bresler et al. | 585/323 |

OTHER PUBLICATIONS

Sinnot, R. K., Chemical Engineering, Chemical Engineering Design, vol. 6 Fourth Edition, Elsevier, 2005, p. 50.*
U.S. Appl. No. 13/327,164, filed Dec. 15, 2011, Moser et al.
U.S. Appl. No. 13/327,200, filed Dec. 15, 2011, Moser et al.
U.S. Appl. No. 13/327,143, filed Dec. 15, 2011, Moser et al.
U.S. Appl. No. 13/327,212, filed Dec. 15, 2011, Moser et al.
U.S. Appl. No. 13/327,220, filed Dec. 15, 2011, Moser et al.
U.S. Appl. No. 13/327,185, filed Dec. 15, 2011, Serban et al.
U.S. Appl. No. 13/327,170, filed Dec. 15, 2011, Serban et al.
U.S. Appl. No. 13/327,192, filed Dec. 15, 2011, Serban et al.

* cited by examiner

*Primary Examiner* — In Suk Bullock
*Assistant Examiner* — Philip Louie

(57) ABSTRACT

A process for reforming a hydrocarbon stream is presented. The process involves splitting a naphtha feedstream to at least two feedstreams and partially processing each feedstream in separate reactors. The processing includes passing the light stream to a combination hydrogenation/dehydrogenation reactor. The process reduces the energy by reducing the endothermic properties of intermediate reformed process streams.

16 Claims, 1 Drawing Sheet

INTEGRATED HYDROGENATION/DEHYDROGENATION REACTOR IN A PLATFORMING PROCESS

FIELD OF THE INVENTION

The present invention relates to a process for enhancing the production of aromatics compounds. In particular the improvement and enhancement of aromatic compounds such as benzene, toluene and xylenes from a naphtha feedstream.

BACKGROUND OF THE INVENTION

The reforming of petroleum raw materials is an important process for producing useful products. One important process is the separation and upgrading of hydrocarbons for a motor fuel, such as producing a naphtha feedstream and upgrading the octane value of the naphtha in the production of gasoline. However, hydrocarbon feedstreams from a raw petroleum source include the production of useful chemical precursors for use in the production of plastics, detergents and other products.

The upgrading of gasoline is an important process, and improvements for the conversion of naphtha feedstreams to increase the octane number have been presented in U.S. Pat. No's. 3,729,409, 3,753,891, 3,767,568, 4,839,024, 4,882,040 and 5,242,576. These processes involve a variety of means to enhance octane number, and particularly for enhancing the aromatic content of gasoline.

While there is a move to reduce the aromatics in gasoline, aromatics have many important commercial uses. Among them include the production of detergents in the form of alkyl-aryl sulfonates, and plastics. These commercial uses require more and purer grades of aromatics. The production and separation of aromatics from hydrocarbons streams are increasingly important.

Processes include splitting feeds and operating several reformers using different catalysts, such as a monometallic catalyst or a non-acidic catalyst for lower boiling point hydrocarbons and bi-metallic catalysts for higher boiling point hydrocarbons. Other improvements include new catalysts, as presented in U.S. Pat. No's. 4,677,094, 6,809,061 and 7,799,729. However, there are limits to the methods and catalysts presented in these patents, and which can entail significant increases in costs.

Improved processes are needed to reduce the costs and energy usage in the production of aromatic compounds.

SUMMARY OF THE INVENTION

The present invention is a process for improving the yields of aromatic compounds from a hydrocarbon feedstream. In particular, a preferred feedstream is a full boiling range naphtha. The increase in demand for aromatic compounds enhances the value of converting paraffins, olefins and naphthenes to aromatics.

The process includes passing the hydrocarbon feedstream to a fractionation unit to generate a light stream comprising C7 and lighter hydrocarbons and a heavy stream comprising C8 and heavier hydrocarbons. The process includes passing the light stream to a hydrogenation/dehydrogenation reactor system to generate a first intermediate process stream having C6 and C7 aromatics with a reduced olefin content. The first intermediate process stream is passed to a light reforming reactor system to generate a first aromatics stream, wherein the light reforming reactor system is operated to maintain the temperature as uniformly as possible. The heavy stream is passed to a reforming reactor system, to convert the heavier paraffins to aromatic compounds and generate a reformate stream. The bottoms stream is passed to a bottoms reforming unit to generate a second aromatics stream, wherein the bottoms reforming reactor system is operated to maintain the temperature as uniformly as possible. The first aromatics stream and the second aromatics stream are passed to a reformate splitter to generate a reformate overhead stream and a reformate bottoms stream. The reformate overhead stream is passed to an aromatics recovery unit to generate an aromatics product stream comprising benzene and toluene.

The aromatics recovery unit generates a raffinate stream, and in an alternate embodiment, the raffinate stream is passed to the hydrogenation/dehydrogenation reactor system. The hydrogenation/dehydrogenation reactor system can use a single catalyst that can perform two functions, the hydrogenation of olefins and the dehydrogenate of naphthenes. The catalyst is preferable a metal deposited on an inert support, without any acid function.

Other objects, advantages and applications of the present invention will become apparent to those skilled in the art from the following detailed description and drawings.

DETAILED DESCRIPTION OF THE INVENTION

Figure 1:
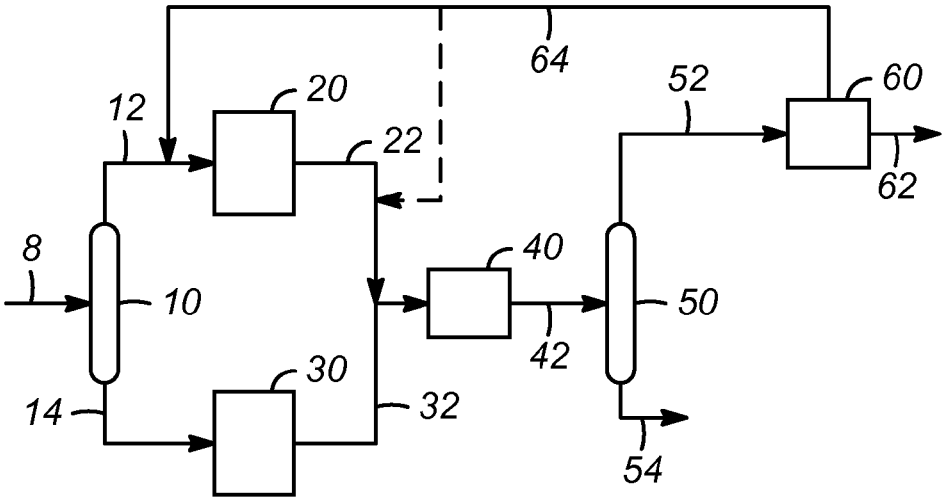
FIG. 1 is a diagram of a first process for increasing aromatics yields by separately processing and reforming light naphthenic and olefinic compounds.

There is an increased demand for aromatics. Important aromatics include benzene, toluene, and xylenes. These aromatics are important components in the production of detergents, plastics, and other high value products. With increasing energy costs, energy efficiency is an important aspect for improving the yields of aromatics. The present invention provides for understanding the differences in the properties of the different components in a hydrocarbon mixture to develop a better process.

The feedstock comprises many compounds and the reforming process proceeds along numerous pathways. The reaction rates vary with temperature, and the Arrhenius equation captures the relationship between the reaction rate and temperature. The reaction rate is controlled by the activation energy for a particular reaction, and with the many reactions in the reforming process, there are many, dissimilar activation energies for the different reactions. For the different reactions, it is possible to manipulate the conversion of one hydrocarbon to a desired product, e.g. hexane to benzene. A process is best operated at isothermal conditions, and produces the highest yields if the reactions are controlled to a narrow temperature range to simulate near isothermal conditions.

The reforming process is substantially endothermic, and requires a continuous addition of heat to maintain the temperature of reaction. Different components within a hydrocarbon mixture have different endothermicities during the reforming process. Separating out the components with the highest endothermicities reduces the heat load to the process. In addition, separate processing of components that take in the most heat allows for more isothermal control of the reforming process downstream. While the description herein describes the reaction temperatures in the reactors, the reaction temperatures refer to the reactor inlet temperatures. The actual reactor temperatures with fluctuate, and drop somewhat from the reactor inlet temperatures. The control of the process is to maintain a relatively constant inlet temperature, with the reactor sized and process controls directed to minimize the temperature drop within the reactors.

While all of the components react differently, it would be impossible to separate out each component. But it has been found that some of the types of components have different properties which significantly affect the reaction process. Dehydrogenation is an important process for the production of aromatics. Generally, naphthenes are highly endothermic, and this requires a continuous addition of heat to the process. By separating the naphthenes from the bulk of the feedstock, and processing the naphthene rich stream separately, downstream reactors can be held in a more near isothermal operation. The process can be utilized with a variety of hydrocarbon feedstreams, but a full boiling range naphtha feedstream having a significant amount of naphthenes and aromatics provides a useful preferred source of hydrocarbons for the generation and recovery of aromatics.

The present invention, as shown in FIG. 1, includes passing a hydrocarbon feedstream 8 to a fractionation unit 10. The fractionation unit 10 is operated to separate the feedstream into an overhead stream 12 having C7 and lighter hydrocarbons, and a bottoms stream 14 having C8 and heavier hydrocarbons. In particular, the operation is for separating light naphtenes, such as cyclohexane, to the overhead stream 12. The overhead stream 12 is passed to a hydrogenation/dehydrogenation reactor system 20, to dehydrogenate the naphtenes and to hydrogenate some of the olefins, to generate a first stream 22 having C6 and C7 aromatics and with a low olefin content. The bottoms stream is passed to a bottoms, or heavy, reforming unit 30 to generate a bottoms reformate 32 having aromatic compounds. The first stream 22 and the bottoms reformate stream 32 are passed to an isothermal reactor system 40 to further convert paraffins to aromatics and to generate an aromatics process stream 42. The aromatics process stream 42 is passed to a reformate splitter 50 to recover the lighter aromatics. The reformate splitter 50 generates a reformate overhead stream 52 having C7 and lighter aromatics, and C7 and lighter compounds such as paraffins. The reformate splitter 50 also generates a reformate bottoms stream 54 having C8 and heavier hydrocarbons. The reformate overhead stream 52 is passed to an aromatics recovery unit 60 to generate an aromatics product stream 62 comprising benzene and toluene. The remainder of the hydrocarbons from the aromatics recovery unit 60 are passed out as a raffinate stream 64 comprising paraffins.

The aromatics recovery unit 60 can comprise different methods of separating aromatics from a hydrocarbon stream. One industry standard is the Sulfolane™ process, which is an extractive distillation process utilizing sulfolane to facilitate high purity extraction of aromatics. The Sulfolane™ process is well known to those skilled in the art.

The process can further include passing the raffinate stream 64 to the hydrogenation/dehydrogenation reactor 20 for further conversion of the hydrocarbons in the raffinate stream 64. The need to pass the raffinate stream 64 to the hydrogenation/dehydrogenation reactor 20 can depend on the amount of naphthenes and olefins in the raffinate stream 64. When the raffinate stream 64 has an olefinic content of at least 10 wt %, the raffinate stream 64 is passed to the hydrogenation/dehydrogenation reactor 20. For a raffinate stream 64 having low naphthene content, the raffinate stream 64 can, in an alternative, be passed to the isothermal reactor system 40.

The passing of high olefinic content streams to the hydrogenation/dehydrogenation reactor system 20 removes olefins that can reduce the reforming catalyst deactivation due to the presence of the olefins in the hydrocarbon stream.

The hydrogenation/dehydrogenation reactor system 20 uses a single catalyst. The catalyst is a non-acid catalyst and ahs a metal function. The preferred catalyst is a metal deposited on an inert support. The catalyst is non-chlorided and performs tow functions, while it is a single catalyst. The catalyst will hydrogenate olefins and also dehydrogenate naphthenes. In studying the reaction rates various classes of hydrocarbons and for various reactions were looked at for catalytic reactions over a catalyst with a platinum metal. For hydrogenation the reaction rates run from about $10^{-2}$ to $10^{2}$ molecules/site-s, and has an operating window generally from 200° C. to 450° C. Dehydrogenation has reaction rates from about $10^{-3}$ to 10 molecules/site-s, and has an operating window generally from 425° C. to 780° C. There is an overlap of these reaction windows where both reactions occur when the temperature in the reactor is held to between 400° C. and 500° C., and preferably 420° C. and 460° C., and more preferably between 425° C. and 450° C. A wider range can be employed depending on the relative amounts of naphthenes and olefins. This allows for the simultaneous reactions of hydrogenation of some hydrocarbon components, while dehydrogenating other hydrocarbon components. In particular, olefins present can be hydrogenated while naphthenes are dehydrogenated.

Preferably, the hydrogenation/dehydrogenation reactor system 20 is a fixed bed reactor system, but it is intended to include other types of reactor bed structures within this invention, including, but not limited to, moving bed systems, bubbling bed systems, and stirred reactor bed systems.

The catalyst in the hydrogenation/dehydrogenation reactor system 20 is preferably a metal only catalyst on a support, where the choice of catalyst metal is from a Group VIII noble elements of the periodic table. The Group VIII noble metal may be selected from the group consisting of platinum, palladium, iridium, rhodium, osmium, ruthenium, or mixtures thereof. Platinum, however, is the preferred Group VIII noble metal component. It is believed that substantially all of the Group VIII noble metal component exists within the catalyst in the elemental metallic state. Preferably, the catalyst in the hydrogenation/dehydrogenation reactor has no acid function.

Preferably the Group VIII noble metal component is well dispersed throughout the catalyst. It generally will comprise about 0.01 to 5 wt. %, calculated on an elemental basis, of the final catalytic composite. Preferably, the catalyst comprises about 0.1 to 2.0 wt. % Group VIII noble metal component, especially about 0.1 to about 2.0 wt. % platinum.

The Group VIII noble metal component may be incorporated in the catalytic composite in any suitable manner such as, for example, by coprecipitation or cogelation, ion exchange or impregnation, or deposition from a vapor phase or from an atomic source or by like procedures either before, while, or after other catalytic components are incorporated. The preferred method of incorporating the Group VIII noble metal component is to impregnate the support with a solution or suspension of a decomposable compound of a Group VIII noble metal. For example, platinum may be added to the support by commingling the latter with an aqueous solution of chloroplatinic acid. Another acid, for example, nitric acid or other optional components, may be added to the impregnating solution to further assist in evenly dispersing or fixing the Group VIII noble metal component in the final catalyst composite.

The support can include a porous material, such as an inorganic oxide or a molecular sieve, and a binder with a weight ratio from 1:99 to 99:1. The weight ratio is preferably from about 1:9 to about 9:1. Inorganic oxides used for support include, but are not limited to, alumina, magnesia, titania, zirconia, chromia, zinc oxide, thoria, boria, ceramic, porcelain, bauxite, silica, silica-alumina, silicon carbide, clays, crystalline zeolitic aluminasilicates, and mixtures thereof. Porous materials and binders are known in the art and are not presented in detail here.

The isothermal reactor system 40 can comprise a plurality of smaller reactors operated sequentially, with inter-reactor heat exchangers between sequential reactors. This provides for maintaining the process nearer to isothermal conditions.

The process can further include passing the feedstream 8 to a hydrotreater (not shown) before passing the feedstream to the fractionation unit 10. The hydrotreater removes sulfur compounds prior to passing the hydrocarbon stream to the catalytic reactors, thereby providing protection to the catalysts by removing common catalytic poisons.

The isothermal reactor system 40 utilizes a reforming catalyst and is operated at a temperature between 520° C. and 600° C., with a preferred operating temperature between 540° C. and 560° C., with the reaction conditions controlled to maintain the isothermal reactions at or near 540° C. A plurality of reactor with inter-reactor heaters provides for setting the reaction inlet temperatures to a narrow range, and multiple, smaller reactors allow for limiting the residence time and therefore limiting the temperature variation across the reactor system 40. The process or reforming also includes a space velocity between 0.6 $hr^{-1}$ and 10 $hr^{-1}$. Preferably the space velocity is between 0.6 $hr^{-1}$ and 8 $hr^{-1}$, and more preferably, the space velocity is between 0.6 $hr^{-1}$ and 5 $hr^{-1}$. Due to the elevated temperature, the problems of potential increased thermal cracking are addressed by having a shorter residence time of the process stream in the isothermal reactor system 40. An aspect of the process can use a reactor with an internal coating made of a non-coking material. The non-coking material can comprise an inorganic refractory material, such as ceramics, metal oxides, metal sulfides, glasses, silicas, and other high temperature resistant non-metallic materials. The process can also utilize piping, heater internals, and reactor internals using a stainless steel having a high chromium content. Stainless steels having a chromium content of 17% or more have a reduced coking ability.

Reforming catalysts generally comprise a metal on a support. The support can include a porous material, such as an inorganic oxide or a molecular sieve, and a binder with a weight ratio from 1:99 to 99:1. The weight ratio is preferably from about 1:9 to about 9:1. Inorganic oxides used for support include, but are not limited to, alumina, magnesia, titania, zirconia, chromia, zinc oxide, thoria, boria, ceramic, porcelain, bauxite, silica, silica-alumina, silicon carbide, clays, crystalline zeolitic aluminasilicates, and mixtures thereof. Porous materials and binders are known in the art and are not presented in detail here. The metals preferably are one or more Group VIII noble metals, and include platinum, iridium, rhodium, and palladium. Typically, the catalyst contains an amount of the metal from about 0.01% to about 2% by weight, based on the total weight of the catalyst. The catalyst can also include a promoter element from Group IIIA or Group IVA. These metals include gallium, germanium, indium, tin, thallium and lead.

Figure 2:
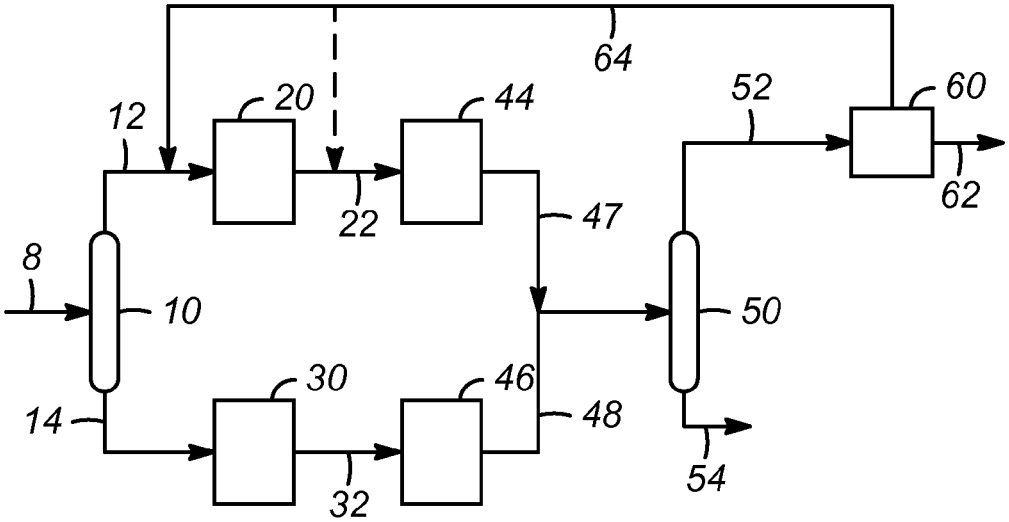
FIG. 2 is a diagram of a second process for increasing aromatics yields by processing the light and heavy hydrocarbon streams separately.

A second process for improving the production of aromatic compounds from a full boiling range naphtha is presented as shown in FIG. 2. The process includes passing the naphtha feedstream 8 to a fractionation unit 10 to generate an overhead stream 12 having C7 and lighter hydrocarbons and a bottoms stream 14 having C8 and heavier hydrocarbons. The overhead stream 12 is passed to a hydrogenation/dehydrogenation reactor system 20, where a first stream 22 is generated having a low olefin content, a reduced naphthene content and an increased C6 and C7 aromatics content. The first stream 22 is passed to a light reforming reactor system 44 to generate a first aromatics stream 47. The light reforming reactor system 44 is operated to be a substantially isothermal system.

The bottoms stream 14 is passed to a bottoms reforming unit 30 for conversion of some of the hydrocarbons, including the naphthenes to aromatics, and generates a second stream 32 having a reduced naphthene content. The second stream 32 is passed to a heavy reforming reactor system 46, thereby generating a second aromatics stream 48. The first 47 and second 48 aromatics streams are passed to a reformate splitter 50. The reformate splitter 50 generates a reformate overhead stream 52 having C7 and lighter aromatics and hydrocarbons, and a reformate bottoms stream 54 having C8 and heavier hydrocarbons. The reformate overhead stream 52 is passed to an aromatics recovery unit 60 to generate an aromatics product stream 62, and a raffinate stream 64. The aromatics product stream 62 comprises benzene and toluene, and can include small amounts of xylenes.

The process can further include passing the raffinate stream 64 to the hydrogenation/dehydrogenation reactor system 20 for hydrogenating the olefins. In an alternative, if the raffinate stream 64 is sufficiently low in olefin content, the raffinate stream 64 can be passed to the light reforming reactor system 44.

The hydrogenation/dehydrogenation reactor system 20 uses a single catalyst that will perform both the function of hydrogenating olefins and dehydrogenating naphthenes. The hydrogenation/dehydrogenation reaction is operated in a relatively narrow temperature window where both reactions occur when the temperature in the reactor is held to between 400° C. and 500° C., and preferably 420° C. and 460° C., and more preferably between 425° C. and 450° C. When the catalyst contacts an olefin, it performs a hydrogenation of the olefin, but if the catalyst contacts a naphthene, it performs a dehydrogenation of the naphthene. This reactor also processes the hydrocarbon components that have the greatest amount of endothermicity in the conversion to aromatics. The conversion of these components before passing the first stream 22 on to the isothermal system 44 reduces the energy input to the light reforming reactor system 44. The isothermal system 44 can comprise a plurality of smaller reactors with inter-reactor heaters for maintaining a substantially isothermal reaction system.

The bottoms reforming unit 30 is operated at a temperature lower than the heavy reforming reactor system 46. The heavy reforming reactor system 46 can comprise a plurality of reactors with inter-reactor heaters, and is operated as a substantially isothermal process. The preferred operating temperature range for the heavy reforming reactor system 46 is between 520° C. and 600° C., with a preferred operating temperature between 540° C. and 560° C., with the reaction conditions controlled to maintain the isothermal reactions at or near 540° C. The bottoms reforming unit 30 is operated at a lower temperature and a temperature range for the bottoms unit 30 is from 420° C. to 540° C., with a preferred temperature between 440° C. and 500° C. The bottoms reforming unit 30 provides for the conversion of higher endothermic components before passing the second stream 32 on to the isothermal heavy reforming reactor system 46.

In an alternate embodiment, the heavy reforming reactor system 46 is operated at a lower temperature, such as in the temperature range from 420° C. to 540° C.

This process is useful for a hydrocarbon feedstream having a substantial amount of naphthenic compounds, such as a full boiling range naphtha. The naphtha feedstream 8 can be passed to a hydrotreater for removing sulfur compounds and other compounds that will act as poisons to the catalysts in the reforming reactors.

Therefore, increases can be achieved through innovative flow schemes that allow for process control of the reactions. While the invention has been described with what are presently considered the preferred embodiments, it is to be understood that the invention is not limited to the disclosed embodiments, but it is intended to cover various modifications and equivalent arrangements included within the scope of the appended claims.

The invention claimed is:

1. A process for producing aromatic compounds from a hydrocarbon feedstream, comprising:

passing the hydrocarbon feedstream to a fractionation unit to generate an overhead stream comprising C7 and lighter hydrocarbons including naphthenes and olefins, and a bottoms stream comprising C8 and heavier hydrocarbons;

passing the overhead stream to a hydrogenation/dehydrogenation reactor system and contacting with a hydrogenation/dehydrogenation catalyst consisting of a metal on an inert support to dehydrogenate naphthenes and hydrogenate olefins thereby generating a first stream having C6 and C7 aromatics with low olefin content, wherein the hydrogenation/dehydrogenation reactor system is operated at a temperature between 420° C. and 460° C.;

passing the bottoms stream to a bottoms reforming unit, to generate a second stream comprising aromatics;

passing the first stream to a light reforming reactor system, thereby generating a first aromatics stream, wherein the light reforming reactor system is operated as a substantially isothermal system wherein the substantially isothermal reactor system is operated at a temperature greater than 540° C.;

passing the second stream to a heavy reforming reactor system, thereby generating a second aromatics stream, wherein the heavy reforming reactor system is operated as a substantially isothermal system; and passing the first and second aromatics streams to a reformate splitter, to generate a reformate overhead stream comprising C7 and lighter aromatics and C7 and lighter paraffins, and a bottoms stream comprising C8 and higher hydrocarbons.

2. The process of claim 1 further comprising passing the reformate overhead stream to an aromatics recovery unit to generate an aromatics product stream comprising benzene and toluene, and a raffinate stream.

3. The process of claim 2 further comprising passing the raffinate stream to the hydrogenation/dehydrogenation reactor system.

4. The process of claim 2 further comprising passing the raffinate stream to the light reforming reactor system

5. The process of claim 1 wherein the hydrocarbon feedstream is a full boiling range naphtha.

6. The process of claim 1 wherein the light reforming reactor system comprises a plurality of reactors with inter-reactor heaters.

7. The process of claim 1 wherein the heavy reforming reactor system comprises a plurality of reactors with inter-reactor heaters.

8. The process of claim 1 wherein the hydrogenation/dehydrogenation reactor system is operated at a temperature between 425° C. and 450° C.

9. The process of claim 1 further comprising passing the hydrocarbon feedstream to a hydrotreater before passing the hydrocarbon feedstream to the fractionation unit.

10. A process for producing aromatic compounds from a naphtha feedstream, comprising:

passing the naphtha feedstream to a hydrotreater to generate a treated hydrocarbon stream;

passing the treated hydrocarbon feedstream to a fractionation unit to generate an overhead stream comprising naphthenes, and C7 and lighter hydrocarbons including naphthenes and olefins, and a bottoms stream comprising C8 and heavier hydrocarbons;

passing the overhead stream to a hydrogenation/dehydrogenation reactor system and contacting with a hydrogenation/dehydrogenation catalyst consisting of a metal on an inert support to dehydrogenate naphthenes and hydrogenate olefins thereby generating a first stream having C6 and C7 aromatics with low olefin content and low naphthenic content, wherein the hydrogenation/dehydrogenation reactor system is operated at a temperature between 420° C. and 450° C.;

passing the bottoms stream to a bottoms reforming unit, to generate a second stream comprising aromatics;

passing the first stream to a light reforming reactor system, thereby generating a first aromatics stream, wherein the light reforming reactor system is operated as a substantially isothermal system wherein the substantially isothermal reactor system is operated at a temperature greater than 540° C.;

passing the second stream to a heavy reforming reactor system, thereby generating a second aromatics stream, wherein the heavy reforming reactor system is operated as a substantially isothermal system; and passing the first and second aromatics stream to a reformate splitter, to generate a reformate overhead stream comprising C7 and lighter aromatics and C7 and lighter paraffins, and a bottoms stream comprising C8 and higher hydrocarbon.

11. The process of claim 10 further comprising passing the reformate overhead stream to an aromatics recovery unit to generate an aromatics product stream comprising benzene and toluene, and a raffinate stream.

12. The process of claim 11 further comprising passing a portion of the raffinate stream to the hydrogenation/dehydrogenation reactor.

13. The process of claim 11 further comprising passing a portion of the raffinate stream to the light reforming reactor system.

14. The process of claim 10 wherein the raffinate stream comprises more than 10 wt % olefins.

15. The process of claim 10 wherein the hydrogenation/dehydrogenation catalyst has no acid function.

16. The process of claim 10 wherein the hydrogenation/dehydrogenation reactor is a fixed bed reactor.

* * * * *